US007052368B2

(12) United States Patent
Kim et al.

(10) Patent No.: US 7,052,368 B2
(45) Date of Patent: May 30, 2006

(54) POLISHING PAD FOR CHEMICAL MECHANICAL POLISHING APPARATUS

(75) Inventors: Jin-Kook Kim, Gyeonggi-do (KR); Jae-Phil Boo, Gyeonggi-do (KR); Sang-Seon Lee, Gyeonggi-do (KR); Jong-Bok Kim, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/861,254

(22) Filed: Jun. 3, 2004

(65) Prior Publication Data

US 2004/0248501 A1 Dec. 9, 2004

(30) Foreign Application Priority Data

Jun. 5, 2003 (KR) ..... 10-2003-0036334

(51) Int. Cl.
*B24B 49/00* (2006.01)

(52) U.S. Cl. ..... 451/6; 451/533; 451/527

(58) Field of Classification Search ..... 451/6, 451/5, 8, 9, 41, 60, 285–289, 921, 527, 533
See application file for complete search history.

(56) References Cited

U.S. PATENT DOCUMENTS 6,280,290 B1 * 8/2001 Birang et al. ..... 451/6
6,358,130 B1 * 3/2002 Freeman et al. ..... 451/285
6,454,630 B1 * 9/2002 Tolles ..... 451/6
6,524,164 B1 * 2/2003 Tolles ..... 451/6
6,716,085 B1 * 4/2004 Wiswesser et al. ..... 451/6

FOREIGN PATENT DOCUMENTS

JP 2002-36097 2/2002
KR 1020020082555 10/2002

OTHER PUBLICATIONS

English language abstract of Korean Publication No. 1020020082555.
English language abstract of Japanese Publication No. 2002-36097.

* cited by examiner

*Primary Examiner*—Dung Van Nguyen
(74) *Attorney, Agent, or Firm*—Marger Johnson & McCollom, P.C.

(57) ABSTRACT

Provided is a polishing pad for a chemical mechanical polishing (CMP) apparatus, having a sealing barrier which prevents fluid leakage and moisture accumulation on a window. The polishing pad comprises an upper pad having polishing surface in contact with a wafer, a bottom pad an upper face of which is attached to a lower face of the upper pad and a lower face of which is attached to an upper face of a platen of the CMP apparatus, an aperture through the bottom pad and the upper pad, a transparent window fitted in the aperture in the upper pad, and a sealing barrier, placed between the aperture and an external face of the bottom pad in contact with a fluid, to prevent fluid leakage and accumulation of moisture derived from fluid fed on the polishing surface through the bottom pad.

17 Claims, 4 Drawing Sheets

POLISHING PAD FOR CHEMICAL MECHANICAL POLISHING APPARATUS

This application claims the priority benefit of Korean Patent Application No. 2003-36334 filed on 5 Jun. 2003, in the Korean Intellectual Property Office, the disclosure of which is incorporated herein in its entirety by reference.

BACKGROUND OF THE INVENTION

1. Field of the Invention

The present invention relates to the manufacture a semiconductor device, and more particularly, to a polishing pad having a sealing barrier that prevents the infiltration of fluid or moisture onto a transparent window in a chemical mechanical polishing (CMP) apparatus, so as to allow a user to detect the condition of a product during the course of the CMP.

2. Description of the Related Art

Generally, a chemical mechanical polishing CMP apparatus is used in the manufacture of integrated circuits on a semiconductor wafer. The CMP apparatus is mainly used for planarizing or patterning various material layers on wafers. The CMP is employed for polishing of a surface of the wafer with a polishing pad, typically using a polishing fluid, typically a slurry of chemical polishing materials, applied onto a polishing surface.

FIG. 1 is a cross-sectional view of a conventional CMP apparatus, and FIG. 2 is a cross-sectional view of the conventional CMP having a window which serves as a pathway for an optical beam. Referring to FIG. 1, the conventional CMP apparatus for planarizing a semiconductor wafer 10 comprises a platen 35 which revolves around a rotational axis 36 for turning a polishing pad 20 and a head 31 which in turn holds and revolves the wafer 10 around another rotational axis 32. A polishing pad 21 adheres to the upper face of a platen 35. The polishing pad 20 comprises the upper polishing pad 21, which is a hard pad that has a polishing surface contacting the wafer 10, and a bottom pad 23, which is a soft pad located on a back side of the upper polishing pad 21.

When polishing the wafer 10 with the conventional CMP apparatus, it is essential to check the surface state of the wafer 10 to control the polishing process or to detect accurately a polishing end point. Various methods are employed in this respect, and among them, an optical method as illustrated in FIG. 1 is widely adopted. In the optical method, an optical beam 34 is irradiated onto the surface of the wafer 10 by a laser interferometer 32, and the state of the surface of the wafer is analyzed via a reflected beam corresponding with the optical beam 34. For this purpose, an aperture 30 for the passage of the optical beam 34 is provided through the polishing pad 20. This aperture 30 is required to be covered with a transparent window 40 because the polishing slurry or the like can leak into the aperture during the CMP process.

Referring to FIG. 2, since the aperture 30 is covered by the transparent window 40, a fluid derived from the slurry while polishing the wafer 10, or deionized ("DI") water used for washing, is primarily prevented from leaking into the aperture 30. However, moisture 60 or dew that accumulates on the surface of the window 40 scatters the optical beam. This results in incorrect measurements of the surface state of the wafer 10. Accordingly, the polishing pad 20 must be frequently replaced by a new polishing pad for accurately checking the surface state of the wafer 10 or for detecting the polishing end point.

In order to overcome this problem, several methods to prevent leakage of fluid on the window 40 have been proposed such as in U.S. Pat. No. 6,358,130. However, the moisture 60 still occurs on the surface of the window 40 due to moisture permeation through the bottom pad 23 of the polishing pad 20 as depicted in FIG. 2.

The bottom pad 23 of the polishing pad 20 performs as a buffer layer to improve the uniformity of the polishing. Therefore, the bottom pad 23 is preferably made of a soft material, for example, sponge, which has a flexible texture. The bottom pad 23 is attached to upper polishing pad 21 via a binding layer 51. The lower face of the bottom pad 23 is attached to platen 35 via a binding layer 55. This structure of polishing pad 20 is similar to the IC 1000 pad and IC 1010 pad of Rodel, U.S.A. which are widely used for a CMP apparatus presently.

However, even though this structure of the polishing pad 20 prevents fluid from leaking through the gap between the window 40 and the upper pad 21, preventing fluid from leaking through the bottom pad 23 is practically impossible since the bottom pad 23 is made of a soft material exposed to the slurry or to the DI water. As the polishing process is repeated, fluid leakage becomes more severe, and moisture eventually accumulates on the back side of the window 40 at the aperture 30. For example, moisture will likely occurs on the back face of the window 40 after polishing approximately 2000 times using the IC 1010 pad for a CMP apparatus. Accordingly, the polishing pad 20 will be eventually replaced because of detecting the end point of polishing becomes impossible.

SUMMARY OF THE INVENTION

The present invention provides a polishing pad that prevents a fluid from leaking and accumulating onto a window as a pass-way of an optical beam in a chemical mechanical polishing (CMP) apparatus, in order to have a higher reliability in detecting an end point of polishing and checking a surface state of a wafer by an optical beam.

According to an aspect of the present invention, there is provided a polishing pad for a CMP apparatus in order to prevent fluid leakage and accumulation of moisture onto a window as a pass-way of an optical beam for checking a state of a wafer or detecting a polishing limit during a CMP process.

The polishing pad comprises an upper pad having a polishing surface in contact with the wafer, a bottom pad, an upper face of which is attached to a bottom face of the upper pad and a bottom face of which is attached to an upper face of a platen of the CMP apparatus, an aperture through the upper pad and the bottom pad, a window within the aperture in the upper pad, and a sealing barrier disposed adjacent to the bottom pad for preventing substantial fluid leakage and/or accumulation of moisture from a polishing fluid fed onto the polishing surface.

Preferably, the sealing barrier forms an enclosed configuration surrounding the aperture.

Preferably, the bottom pad is disconnected at a certain point on the sealing barrier, and an upper face of the sealing barrier is attached to the bottom face of the upper pad and a bottom face of the sealing barrier is attached to the upper face of the platen.

A side of the sealing barrier preferably faces the aperture and the other side contacts a side of the bottom pad. Alternatively, a side of the sealing barrier may be exposed to outside along with the outside of the platen and the upper pad, and the other side of the sealing barrier contacts a side of the bottom pad.

The sealing barrier can have the same thickness as the bottom pad. Also, the sealing barrier may have lower fluid permeability than the bottom pad. As an example, the sealing barrier may be formed of the same material as the bottom pad.

According to an aspect of the present invention, a polishing pad comprises: an upper pad having a polishing surface adapted to contact a wafer; a bottom pad, an upper face of which is attached to a bottom face of the upper pad and a bottom face of which is attached to an upper face of a platen of a CMP apparatus; an aperture through the bottom pad and the upper pad; a transparent window disposed within the aperture in the upper pad; and a sealing barrier shielding and preventing the bottom layer from exposed to the aperture and occurring fluid leakage and accumulation of moisture through the bottom pad.

The bottom pad is disconnected at the opposite face of the sealing barrier which faces the aperture, and the upper face of the sealing barrier is attached to the lower face of the upper pad, and a bottom face of the sealing barrier is attached to the upper face of the platen.

The upper face of the sealing barrier is extended to cover portions of a lower face of the window which opposite to the polishing surface and faces the aperture.

The present invention provides a polish pad for a CMP apparatus which prevents reliably fluid leakage and accumulation of moisture on a window as a pathway for an optical beam to detect an end point of polishing or to check a surface condition of a wafer by an optical apparatus.

The present invention will now be described more fully with reference to the accompanying drawings, in which preferred embodiments of the invention are shown. This invention may, however, be embodied in many different forms and should not be construed as being limited to the embodiments set forth herein. Rather, these embodiments are provided so that this disclosure is thorough and complete and fully conveys the concept of the invention to those skilled in the art.

BRIEF DESCRIPTION OF THE DRAWINGS

The above object and advantages of the present invention will become more apparent by describing in detail preferred embodiments thereof with reference to the attached drawings.

DETAILED DESCRIPTION OF THE PREFERRED EMBOIDMENTS

Figure 1:
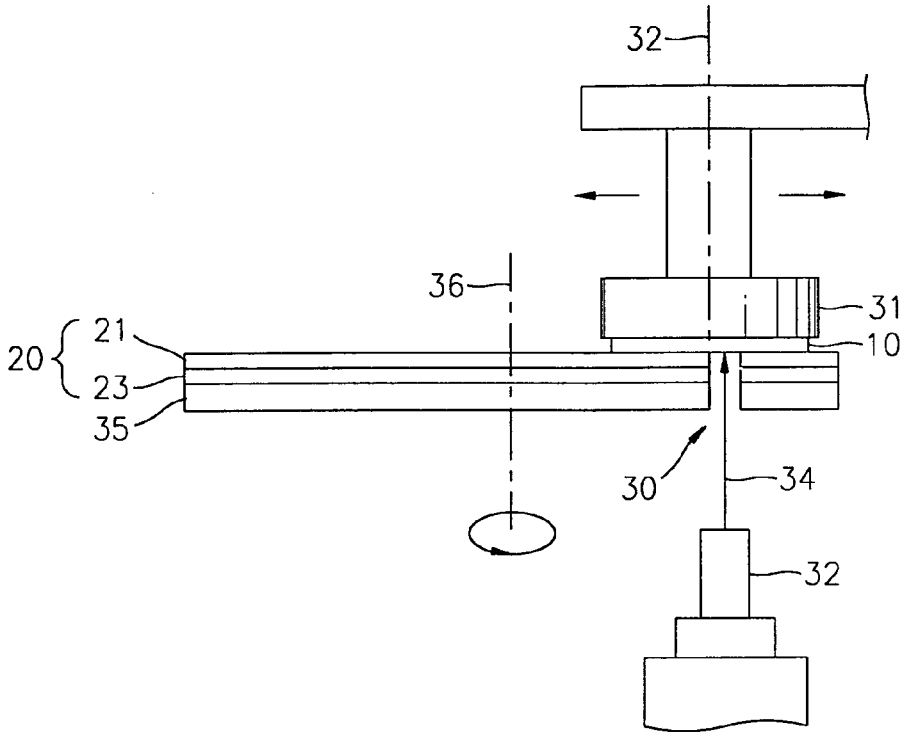
FIG. 1 (PRIOR ART)
FIG. 1 is a configuration of a conventional chemical mechanical polishing (CMP) apparatus.

In the embodiments of the present invention, a polishing pad having a sealing barrier which blocks the permeation of fluid or moisture through the bottom pad to an aperture which acts as a pathway for an optical beam is introduced for polishing a wafer. The polishing pad is applicable to a conventional CMP apparatus as shown in FIG. 1.

The sealing barrier is formed of a material with lower degree of permeability than a bottom pad made of a soft pad. Therefore, it acts as a buffer layer that enhances the uniformity of the polishing of a wafer, and blocks the fluid and moisture from permeating the bottom pad.

Thus, the fluid or moisture, due to the polishing slurry or DI water used during the polishing process, which contacts an external face of the bottom pad, can be effectively prevented form clogging the aperture. Accordingly, moisture does not accumulate on a back face of a transparent window through which the optical beam passes. Also, a difficulty of detecting the surface condition of a wafer, or detecting an end point of polishing thereof, is overcome. Therefore, the lifetime of the polishing pad can be extended significantly.

Figure 3:
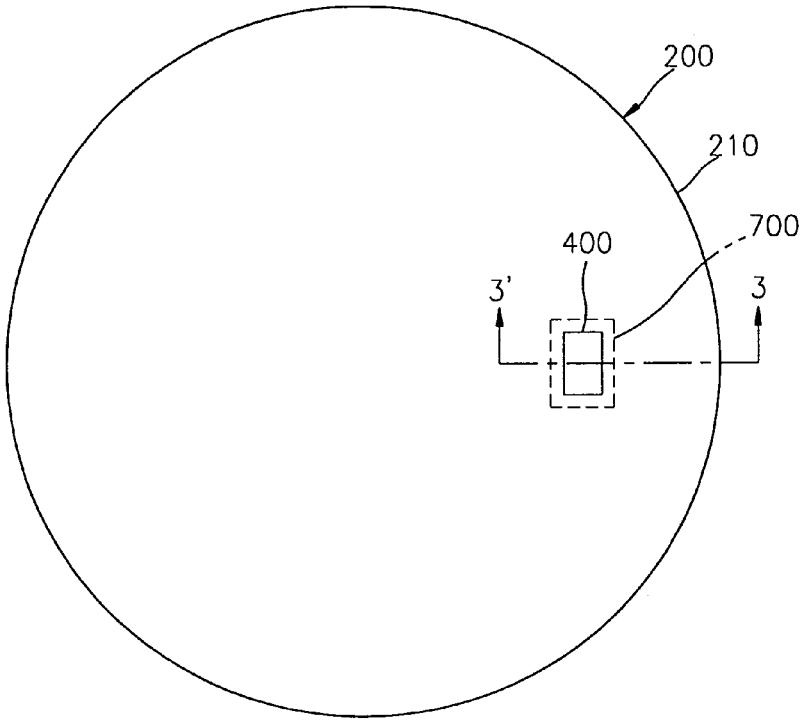
FIG. 3 is a plan view of a polishing pad for a CMP apparatus, the polishing pad having a sealing barrier According to an embodiment of the present invention.
Figure 4:
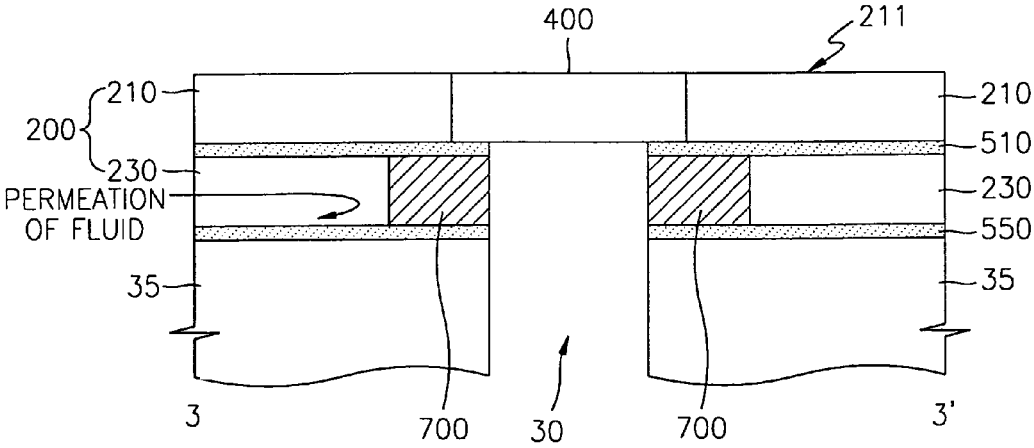
FIG. 4 is a cross-sectional view of the polishing pad along line 3—3' in FIG. 3.
Figure 5:
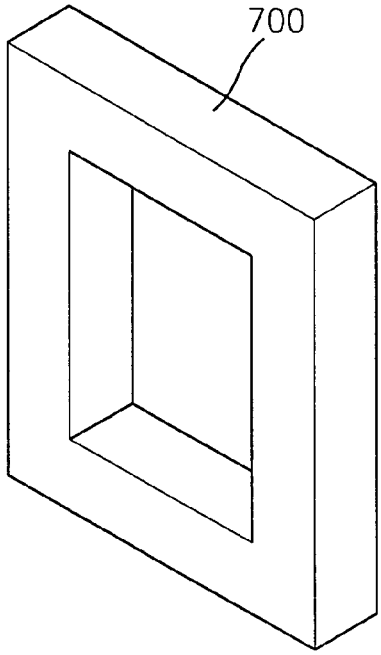
FIG. 5 is a perspective view of a sealing barrier of FIG. 4.

Referring to FIGS. 3 through 5, a polishing pad 200 according to an embodiment of the present invention comprises an upper pad 210 having an outer polishing surface 211 to chemically mechanically polish a wafer. A bottom pad 230 is attached to a back side of the upper pad 210 and to a sealing barrier 700. The upper pad 210 can be made of a polymeric material such as a polyurethane, and the bottom pad 230 can be formed from a soft material pad such as a sponge.

An upper surface of the bottom pad 230 is attached to a back face of the upper pad 210 via a binding layer 510, and a back face of the bottom pad 230 is attached to an upper face of a platen 35 of the CMP apparatus via a binding layer 550. An aperture, which is a pathway for an optical beam 30, is provided through the bottom pad 230 and the upper pad 210. The aperture 30, allows the optical beam irradiated by an optical apparatus, such as the laser interferometer 32 in FIG. 1, to reach a wafer in order to check the state of the wafer and to detect the polishing end point.

During the polishing process, a slurry or DI rinse water is supplied onto the polishing surface 211 of the upper pad 210. To protect the aperture 30 from clogging and the optical apparatus thereunder from the effects of the slurry and/or the DI water, a window 400 is introduced at the upper part of the aperture 30.

The window 400 can be made of a polymeric material such as a polyurethane. In any case, however, the window should be transparent in order to allow the optical beam to pass therethrough.

The bottom pad 230 described above is formed of a soft material in order to enhance polishing uniformity. Accordingly, the bottom pad 230 has relatively higher permeability than the upper pad 210. Due to this, a fluid can easily pass through the bottom pad 230. In order to prevent moisture from accumulating on the window 400, due to fluid passing the bottom pad 230, the sealing barrier 700 is placed between the bottom pad 230 and the aperture 30.

The sealing barrier 700 is placed close to the aperture 30 in order to block the side wall of the bottom pad 230 from reaching the aperture 30 as shown in FIG. 4. In this way, even if the fluid permeates the bottom pad 230 as indicated in FIG. 4, the fluid or moisture cannot reach the aperture 30, thereby preventing the moisture from accumulating onto the window 400. The sealing barrier 700 can be placed not only directly surrounding the aperture 30 but also at a predetermined distance from the aperture 30.

Since the sealing barrier 700 blocks the fluid or moisture from clogging the aperture 30, it is preferable for it to have a closed loop configuration as suggested in FIG. 5. The loop may have a square shape as indicated in FIG. 5, or alternatively, circular or oval.

Also, it is preferable that the sealing barrier 700 be formed of an impermeable material. It is preferable that the sealing barrier 700 be formed of a material having lower permeability than the bottom pad 230. For example, the sealing barrier 700 can be formed of a polymeric material such as a polyurethane. Moreover, the sealing barrier 700 may be formed of the same material being used for the upper pad 210.

On the other hand, the sealing barrier 700 can have many different forms, other than a square, circular, or oval shape. However, it is preferable that the bottom pad 230 be disconnected at a certain point on the sealing barrier 700, the upper surface of the bottom pad 700 be attached to the lower surface of the upper pad 210, and the bottom surface of the sealing barrier 700 be attached to the upper surface of the platen 35. That is, as shown in FIG. 4, it is preferable that at least one side of the sealing barrier 700 faces the aperture 30, and another side of the sealing barrier 700 contacts the bottom pad 230.

For this purpose, it is preferable that the binding layers 510 be extended to the interface between the sealing barrier 700 and the upper pad 210, and that the binding layer 550 be extended to the interface of the upper face of the platen 35. Also, it is preferable that a thickness of the sealing barrier 700 be the same as that of the bottom pad 230 or a bit greater than that of the bottom pad 230.

Figure 2:
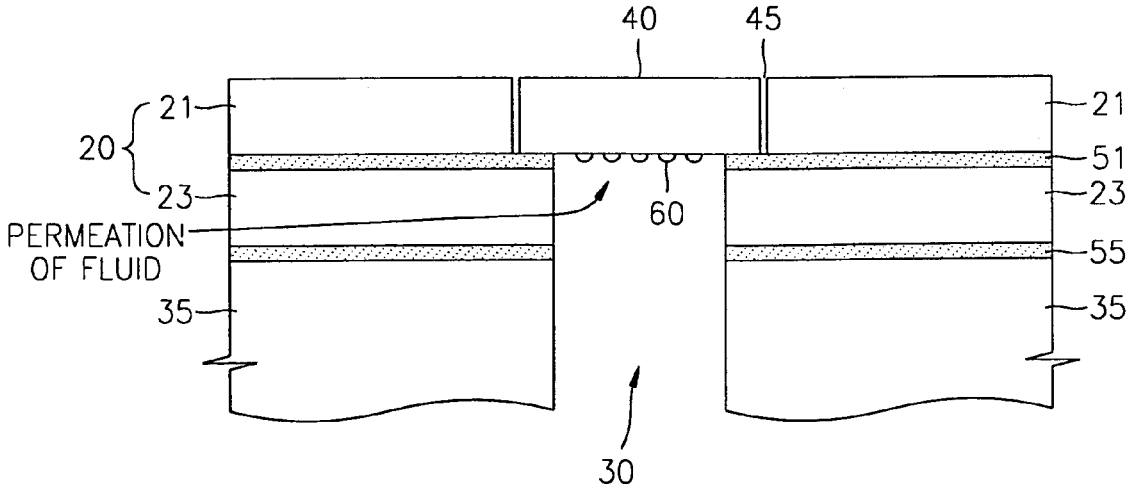
FIG. 2 (PRIOR ART)
FIG. 2 is a cross-sectional view of a conventional CMP pad having a window as pathway for the transmission of an optical beam.

On the other hand, as shown in FIG. 4, it is preferable that the lower surface of the window 400 be extended to cover a portion of the upper surface of the sealing pad 700. The purpose of this extension is to make the sealing barrier 700 block fluid entering into the aperture 30 when fluid leaks 45 in FIG. 2 through the gap between the window 400 and the upper pad 210.

Figure 6:
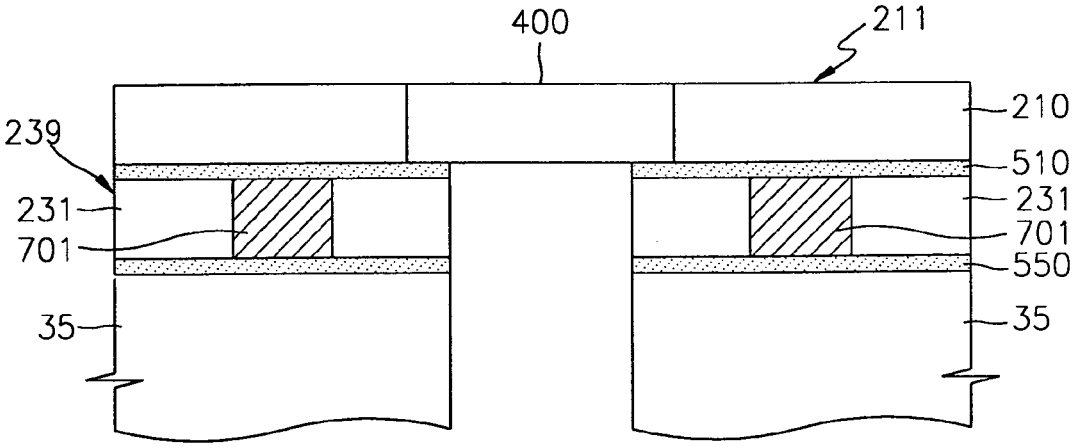
FIGS. 6 and 7 are cross-sectional views of the sealing barrier in position with respect to the polishing pad According to an embodiment of the present invention.

Referring to FIG. 6, a sealing barrier 701 is placed in the middle of a bottom pad 231.

Figure 7:
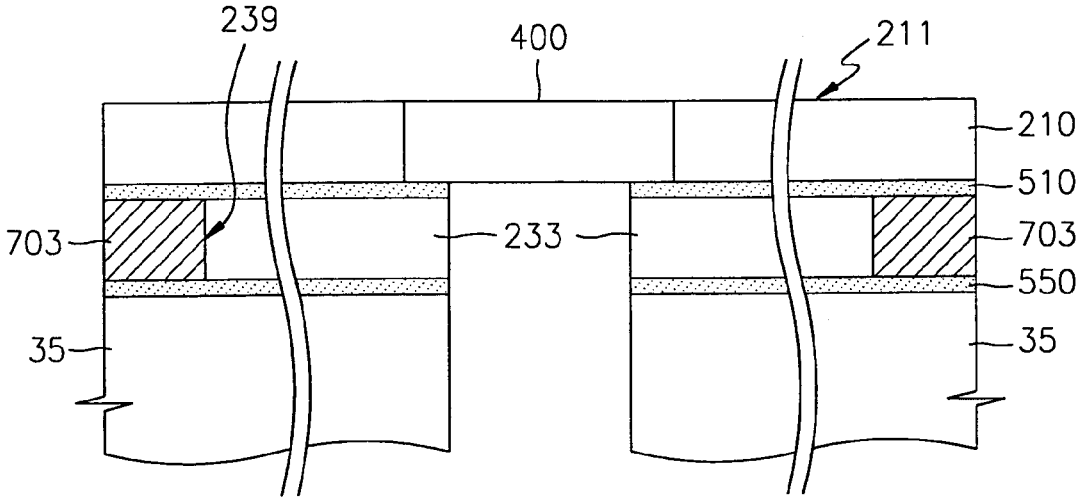

Referring to FIG. 7, a sealing barrier 703 is placed to protect a bottom pad 233 from the slurry and/or DI water supplied during a CMP process by covering an external face 239 of the bottom pad 233. In other words, the sealing barrier 703 has a side facing toward and aligned with an external side of the upper pad 210, while another side of the sealing barrier 703 contacts the bottom pad 233.

According to an embodiment of the present invention, by placing a sealing barrier between the bottom pad as a part of the polishing pad for a CMP apparatus and the aperture as a pathway for an optical beam to detect the polishing limit, the fluid or moisture due to the slurry and/or DI water present during a polishing process in contact with an external face of the bottom pad, is effectively prevented form clogging the aperture. Therefore, the lifetime of the polishing pad can be extended significantly.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A polishing pad for a chemical mechanical apparatus, including a platen, for polishing a semiconductor wafer, comprising:

an upper pad having a polishing surface adapted to contact the semiconductor wafer;

a bottom pad having an upper face attached to a bottom face of the upper pad, and a bottom face attached to an upper face of the platen;

an aperture formed through the bottom pad and the upper pad;

a window within the aperture in the upper pad; and a sealing barrier disposed adjacent to the bottom pad to prevent substantial fluid leakage and/or accumulation of moisture from a polishing fluid fed onto the polishing surface, wherein a side of the sealing barrier faces the aperture and another side of the sealing barrier is in contact with a side of the bottom pad.

2. The polishing pad of claim 1, wherein the sealing barrier forms an enclosed configuration surrounding the aperture.

3. The polishing pad of claim 1, wherein an upper face of sealing barrier is attached to the bottom face of the upper pad, and a bottom face of the sealing barrier is attached to the upper face of the platen.

4. The polishing pad of claim 1, wherein a side of the sealing barrier, the outside of the platen and the upper pad, respectively, are externally exposed, and the other side of the sealing barrier is in contact with a side of the bottom pad.

5. The polishing pad of claim 1, wherein the sealing barrier has substantially the same thickness as the thickness of the bottom pad.

6. The polishing pad of claim 1, wherein the permeability of the sealing barrier is lower than the permeability of the bottom pad.

7. The polishing pad of claim 1, wherein the sealing barrier is formed of the same material as the upper pad.

8. A polishing pad for a chemical mechanical apparatus, including a platen, for polishing a semiconductor wafer, comprising:

an upper pad having a polishing surface adapted to contact the semiconductor wafer;

a bottom pad having an upper face attached to the bottom face of the upper pad, and a bottom face attached to an upper face of the platen;

an aperture through the bottom pad and the upper pad;

a transparent window disposed within the aperture of the upper pad; and a sealing barrier arranged and structured to shield and prevent the bottom pad from being exposed to the aperture preventing substantial fluid leakage and/or accumulation of moisture through the bottom pad, wherein an upper face of the sealing barrier is attached to the bottom face of the upper pad, and a bottom face of the sealing barrier is attached to the upper face of the platen.

9. The polishing pad of claim 8, wherein a side of the sealing barrier faces the aperture and another side of the sealing barrier is in contact with a side of the bottom pad.

10. The polishing pad of claim 8, wherein the sealing barrier has a lower permeability than the permeability of the bottom pad.

11. The polishing pad of claim 8, wherein the sealing barrier is formed of the same material as that of the upper pad.

12. A polishing pad for a chemical mechanical apparatus, including a platen, for polishing a semiconductor wafer, comprising:

an upper pad having a polishing surface adapted to contact the semiconductor wafer;

a bottom pad having an upper face attached to the bottom face of the upper pad, and a bottom face attached to an upper face of the platen;

an aperture through the bottom pad and the upper pad;

a transparent window disposed within the aperture of the upper pad; and a sealing barrier arranged and structured to shield and prevent the bottom pad from being exposed to the aperture preventing substantial fluid leakage and/or accumulation of moisture through the bottom pad, wherein the thickness of the sealing barrier is substantially the same as the thickness of the bottom pad.

13. A method for producing a polishing pad for a chemical mechanical apparatus, including a platen, for polishing a semiconductor wafer, comprising:

providing an upper pad having a polishing surface to be in contact with said semiconductor wafer;

providing a bottom pad having an upper face and a bottom face, wherein the bottom pad and the upper pad having an aperture formed therethrough;

attaching the bottom pad to a bottom face of the upper pad;

attaching the bottom face to an upper face of the platen;

introducing a window within the aperture in the upper pad; and providing a sealing barrier disposed adjacent to the bottom pad to prevent substantial fluid leakage and/or accumulation of moisture from a polishing fluid fed onto the polishing surface, wherein a side of the sealing barrier faces the aperture and another side of the sealing barrier is in contact with a side of the bottom pad.

14. The method of claim 13, wherein the sealing barrier forms an enclosed configuration surrounding the aperture.

15. The method of claim 13, wherein an upper face of sealing barrier is attached to the bottom face of the upper pad, and a bottom face of the sealing barrier is attached to the upper face of the platen.

16. The method of claim 13, wherein a side of the sealing barrier, the outside of the platen and the upper pad, respectively, are externally exposed, and the other side of the sealing barrier is in contact with a side of the bottom pad.

17. A chemical mechanical polishing apparatus for polishing a semiconductor wafer, the apparatus having a platen and a polishing pad which comprises:

an upper pad having a polishing surface adapted to contact the semiconductor wafer;

a bottom pad having an upper face attached to a bottom face of the upper pad, and a bottom face attached to an upper face of the platen;

an aperture formed through the bottom pad and the upper pad;

a window within the aperture in the upper pad; and a sealing barrier disposed adjacent to the bottom pad for preventing substantial fluid leakage and/or accumulation of moisture from a polishing fluid fed onto the polishing surface, wherein a side of the sealing barrier faces the aperture and another side of the sealing barrier is in contact with a side of the bottom pad.

* * * * *